US006962212B2

(12) United States Patent
Riedl

(10) Patent No.: US 6,962,212 B2
(45) Date of Patent: Nov. 8, 2005

(54) MULTIPLE MOUNTING BRACKETS

(75) Inventor: Reinhard Riedl, Finning (DE)

(73) Assignee: Hilti Aktiengesellschaft, Schaan (LI)

( * ) Notice: Subject to any disclaimer, the term of this patent is extended or adjusted under 35 U.S.C. 154(b) by 146 days.

(21) Appl. No.: 10/726,866

(22) Filed: Dec. 3, 2003

(65) Prior Publication Data

US 2004/0163832 A1 Aug. 26, 2004

(30) Foreign Application Priority Data

Dec. 4, 2002 (DE) ..... 102 56 547

(51) Int. Cl.[7] ..... E21B 19/18; E21B 3/00
(52) U.S. Cl. ..... 173/216; 173/217
(58) Field of Search ..... 173/216, 217, 173/213, 162.1; 29/401.1, 469

(56) References Cited

U.S. PATENT DOCUMENTS 4,265,320 A * 5/1981 Tanaka et al. ..... 173/178
4,353,425 A * 10/1982 Simpson ..... 173/109
4,770,254 A * 9/1988 Kominami ..... 173/109
5,136,197 A * 8/1992 Hallett ..... 310/83
5,868,208 A * 2/1999 Peisert et al. ..... 173/178
6,070,675 A * 6/2000 Mayer et al. ..... 173/48
6,213,224 B1 * 4/2001 Furuta et al. ..... 173/217

* cited by examiner

*Primary Examiner*—Scott A. Smith
*Assistant Examiner*—Brian Nash
(74) *Attorney, Agent, or Firm*—Abelman, Frayne & Schwab

(57) ABSTRACT

An electric hand tool (2) including a gearing component (4) and a motor component (6). A mounting bracket (8) is located between the gearing component (4) and the motor component after final assembly. A gear shaft (20) and an motor shaft (30) are suspended on the mounting bracket (8). The mounting bracket (8) features two mounting bracket components (10, 12; 64, 72), of which the gearing component (4) is allocated to one (10; 72) and the motor component (6) is allocated to the other (12; 64). Both mounting bracket components (10, 12; 64, 72) are linked to each other via a connection (46; 74).

11 Claims, 4 Drawing Sheets

50
49
48
46
40
10
14
12
16
20
26
60
46
28
54
34
30
46
28
56
52
40
58
8
49

MULTIPLE MOUNTING BRACKETS

BACKGROUND OF THE INVENTION

The present invention relates to an electric hand tool with a gearing component and a motor component, between which, after final assembly, a mounting bracket is located. A gear shaft and an motor shaft are suspended on the mounting bracket.

In most cases, such mounting brackets are used for applications with radial bearing as well as for the end of the gear shaft pointing towards the motor and the motor shaft. They are thus located between the motor and the gearing for this purpose. The mounting brackets can be designed in various manners, for example, mainly in the form of shields or discs.

A power tool disclosed in DE 21 05 336 has a left and a right casing in machine direction. A mainly discoidal mounting bracket with two cylindrical shaft collet that is made of sintered metal is arranged between the motor and the gearing of the power tool. Two recesses are located on the mounting bracket, by which the mounting bracket is screwed on to one half of the casing using two fastening screws.

Mounting brackets like this have the disadvantage of generating relatively high costs of materials. In addition, the mounting bracket has to be completely redesigned every time the motor or the gearing is further developed whereby the dimensions of the motor shaft or the gear shaft in comparison to the mounting bracket are altered. In general, mounting brackets generate generally high manufacturing costs.

SUMMARY OF THE INVENTION

The object of the invention is to present an electric hand tool with a mounting bracket and at the same time avoid the above-mentioned disadvantages and lower the manufacturing costs.

This object is achieved by using a mounting bracket with at least two mounting bracket components. Before final assembly, one of the two mounting bracket components can be separately attached to the other mounting bracket component on the motor component while the other mounting bracket component can be attached to the gear component.

It is therefore possible to design the mounting bracket such that one of the mounting bracket components merely depends on the measurements of the motor component and the motor shaft while the other mounting bracket component merely depends on the measurements of the gearing component and the gear shaft, due to the fact that the mounting bracket consist of at least two components, especially as two partial bearing shields. If for example, the gearing component of the electric hand tool is further developed while the existing motor continues to be used then only the mounting bracket component pointing towards the gearing has to be redesigned. All manufacturing devices or settings, like casting molds or machine settings, which have been arranged for the existing mounting bracket component pointing towards the motor, can thus be continued to be used despite alterations to the gearing. It is additionally possible to assemble relatively elaborate mounting bracket designs from relatively simple forms of mounting bracket components. The manufacturing costs of the mounting bracket and the complete electric hand tool can therefore be lowered overall.

It is now additionally possible to mount both the component pointing to the motor and the component pointing to the gearing of the electric hand tool in advance with the respective mounting bracket component. Final assembly of the electric hand tool is, on the one hand, greatly simplified and, on the other hand, the motor component and the gearing component are separate units that can also be tested separately. Various tests and checks, like endurance and high voltage testing, can thus be carried out on the motor component and on the gearing component separately and independent of the other component.

It is advantageous that the mounting bracket components are connected with each other at final assembly but can be detached from each other. Such a detachable connection can be created using screws or bolts, thus making it easy to attach various gearing components to one motor component. Additionally both components of an electric hand tool cannot be easily separated after final assembly to carry out test on one of the components.

Both mounting bracket components can, in an alternative design option, be permanently connected with each other at the time of final assembly. Such a permanent connection can be created by using various welding methods, like spot-welding and laser-welding. This has the advantage of making both mounting bracket components permanently stable and extremely rigid on connection.

It is also advantageous that the mounting bracket components feature an adhesive layer on mutual contact surfaces on final assembly, whereby either permanent or non-permanent adhesive properties of the adhesive layer would come into question. An increased rigidity of the mounting bracket and thus improved operations of the electric hand tool would be attained by this adhesive layer.

It is also advantageous that the adhesive layer has to be heated to develop its adhesive properties. Problems during assembly such as adhering both mounting bracket components to each other in an inaccurate position due to too early adhesion, could thus be avoided. Additional rigidity of the mounting bracket can be achieved through heating as soon as both mounting bracket components have been exactly aligned with each other in the normal manner using screws or spot-welding. In this case, an adhesive layer can be used, which is activated when temperatures rise in the electric hand tool during operation.

It is also advantageous that at least one of the mounting bracket components is made in a stamping procedure. This way relatively elaborate mounting bracket components and thus mounting brackets themselves can be manufactured in a quite simple and cost-effective manner. In addition, this design provides for at least one mounting bracket component being a partial bearing shield, which is a flat and thus space-saving form of mounting bracket component.

At least one of the mounting bracket components should also feature a mainly bowl-shaped shaft collet, in which a journal bearing can be located. A "bowl-shaped" shaft collet means that the mounting bracket component is in part designed like a sleeve with a type of bottom at one end. The floor can also show recesses, through which the suspended shaft protrudes. The journal bearing can, for example, be designed as a roller contact bearing, like for example ball bearings or roller bearings. The journal bearing can be made extremely accurate and stable with this bowl-shaped shaft collet.

It would be advantageous that the journal bearing be crimped into the shaft collet. The journal bearing is thus kept relatively stable in the shaft collet.

In an alternative option, which is also advantageous, at least one of the mounting bracket components features a sleeve-like journal bearing, which shows a block on the first opening and the second opening can at least be partially sealed by the other mounting bracket component. There is thus the possibility that journal bearing be welded between both mounting bracket components.

It is of further advantage that the journal bearing is connected to the remaining mounting bracket component via a sector, which features membranous properties. These membranous properties can thus be attained by an s-shaped layer with elastic properties. The elastic properties of this area result in cushioning the transfer of vibrations between the journal bearing and casing by on lowering the one hand noise development and on the other hand the transfer of vibrations to the person operating.

This invention also suggests that at least one of the mounting bracket components features interchangeable insert bits, thus making it possible to adapt a specific mounting bracket component to suit the new measurements by exchanging the interchangeable insert bits on alteration of the gearing or motor component. A basic design of mounting bracket component can be maintained this way while simple exchanging insert bits. Thus, the manufacturing costs of the electric hand tool are further reduced.

An advantageous design option features drill holes on the mounting bracket, which connect the interior of the gearing component with an internal space in the mounting bracket. This way, dangerous high pressures, which can occur in the gearing during operations, can be avoided. Oil coming from the gearing due to drilling can in addition be caught up in the internal space.

BRIEF DESCRIPTION OF THE INVENTION

In the following section, the invention is described in an exemplary manner with reference to the drawings, wherein.

DETAILED DESCRIPTION OF THE INVENTION

Figure 1:
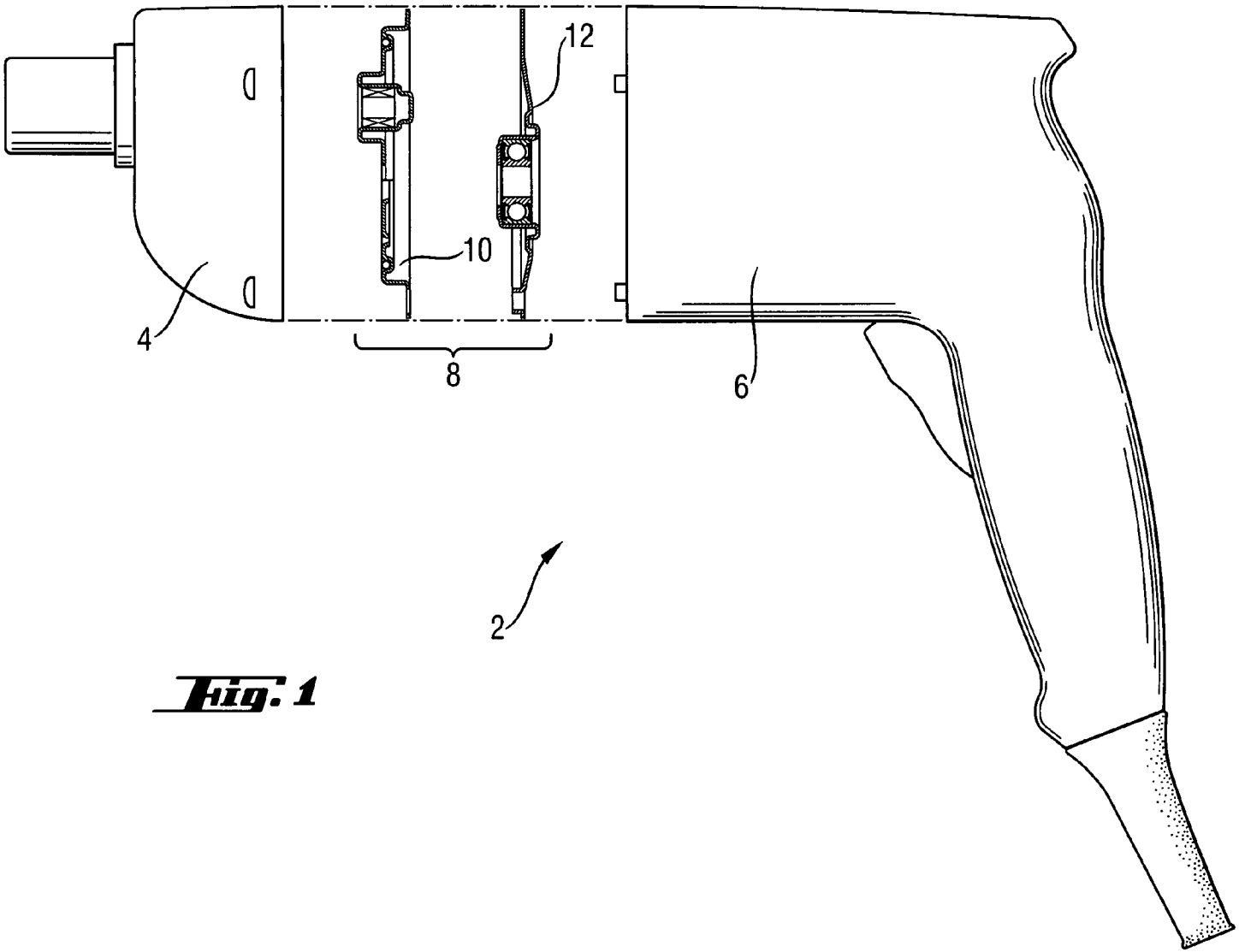
FIG. 1 shows the exploded view of an electric hand tool with a mounting bracket in a side view.

FIG. 1 shows an electric hand tool (2) featuring a separated gearing component (4) and a separated motor component (6). The gearing component (4) and the motor component (6) can be connected with each other using a shield-shaped mounting bracket (8), which presents a mounting bracket 10 pointing towards the gearing and a mounting bracket 12 pointing towards the motor. Both mounting bracket components (10, 12) are designed as stamping components.

Figure 2:
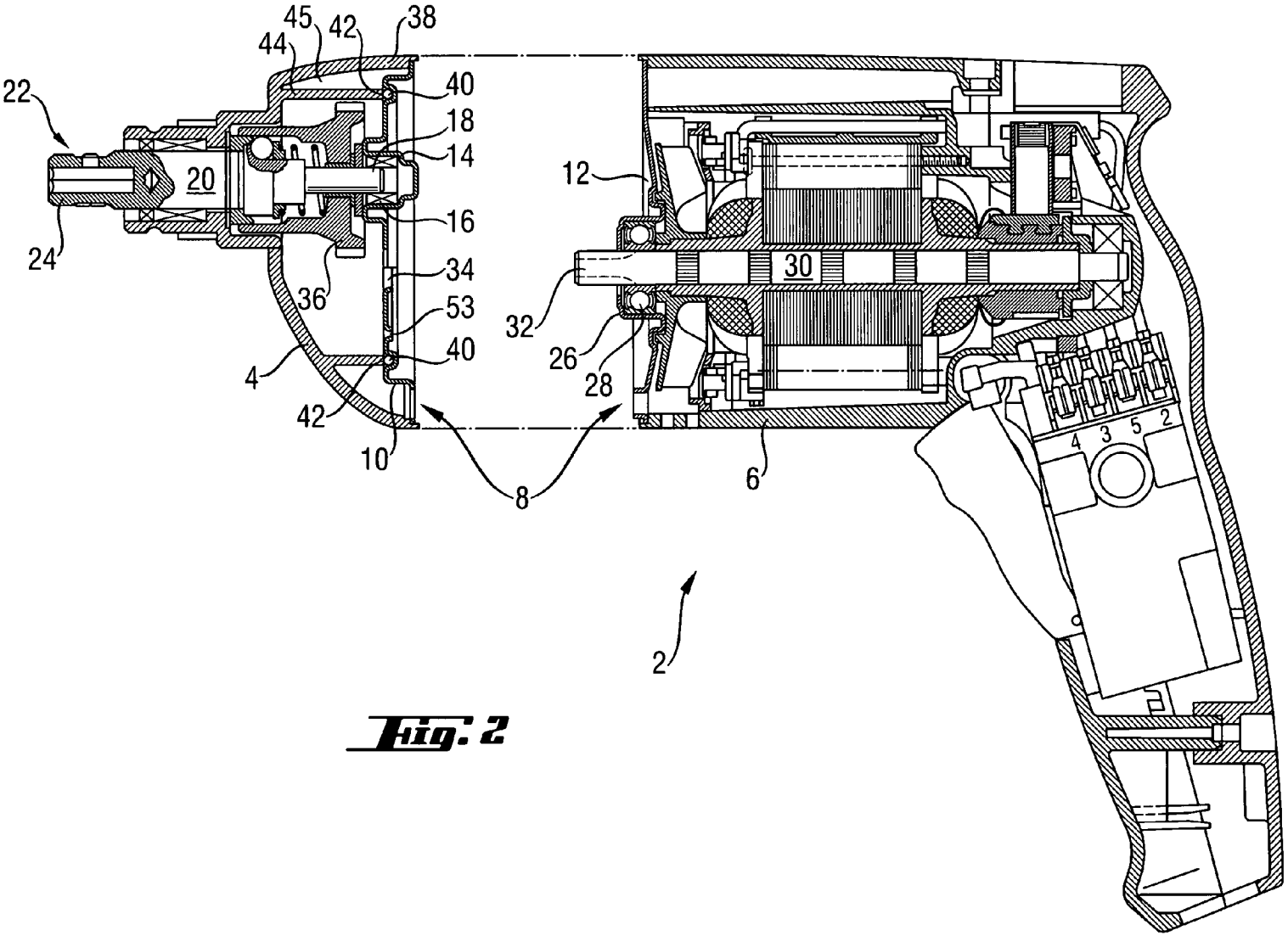
FIG. 2 shows a longitudinal-section of the electric hand tool prior to final assembly whereby the gearing and the motor components have already been attached.

FIG. 2 shows an electric hand tool 2 prior to final assembly. The mounting bracket 10 pointing towards the gearing is now assembled to the gearing component 4 and the mounting bracket 12 pointing towards the motor is assembled to the motor component 6. A bowl-shaped shaft collet 14 pointing towards the gearing, into which a journal bearing 16 pointing towards the gearing designed as a roller bearing is crimped, is fitted on the mounting bracket 10 pointing towards the gearing, which is presented here as a partial bearing shield. The journal bearing 16 pointing towards the gearing comprises a gearing spindle 20 at the end 18 pointing towards the motor. Tool collet 24 is shown at the free end 22 of the gearing spindle 20.

The mounting bracket 12 pointing towards the motor, which is also fitted out with a partial bearing shield, presents a bowl-shaped shaft collet 26 pointing towards the motor, into which a journal bearing 28 pointing towards the motor designed as a ball bearing is crimped. A motor shaft 30, which protrudes out of the motor component 6 with a toothed end 32, is suspended over this journal bearing 28. This toothed end 32 protrudes through a shaft opening 34 of the mounting bracket 10 pointing towards the gearing and into the gearing component 4 where it comes into contact with cogwheel 36, via which the gear shaft 20 can be operated.

The mounting bracket 8 is thus extremely flat and saves a great deal of space, due to the double-sided design of both mounting bracket components 10, 12 as partial bearing shield. A ring-shaped sealing element 40, which is fitted to an edge 42 of the mainly sleeve-shaped interior 44 of gearing component 4 during assembly of the mounting bracket 10 pointing towards the gearing on the gearing component 4, can be found on the mounting bracket 10 pointing towards the gearing in order to prevent oil flowing out of the exterior of the electric hand tool casing 38. An interim unit 45 is designed between the sealing element 40 and the exterior of the casing, as described in DE 201 17 471 U1.

Figure 3:
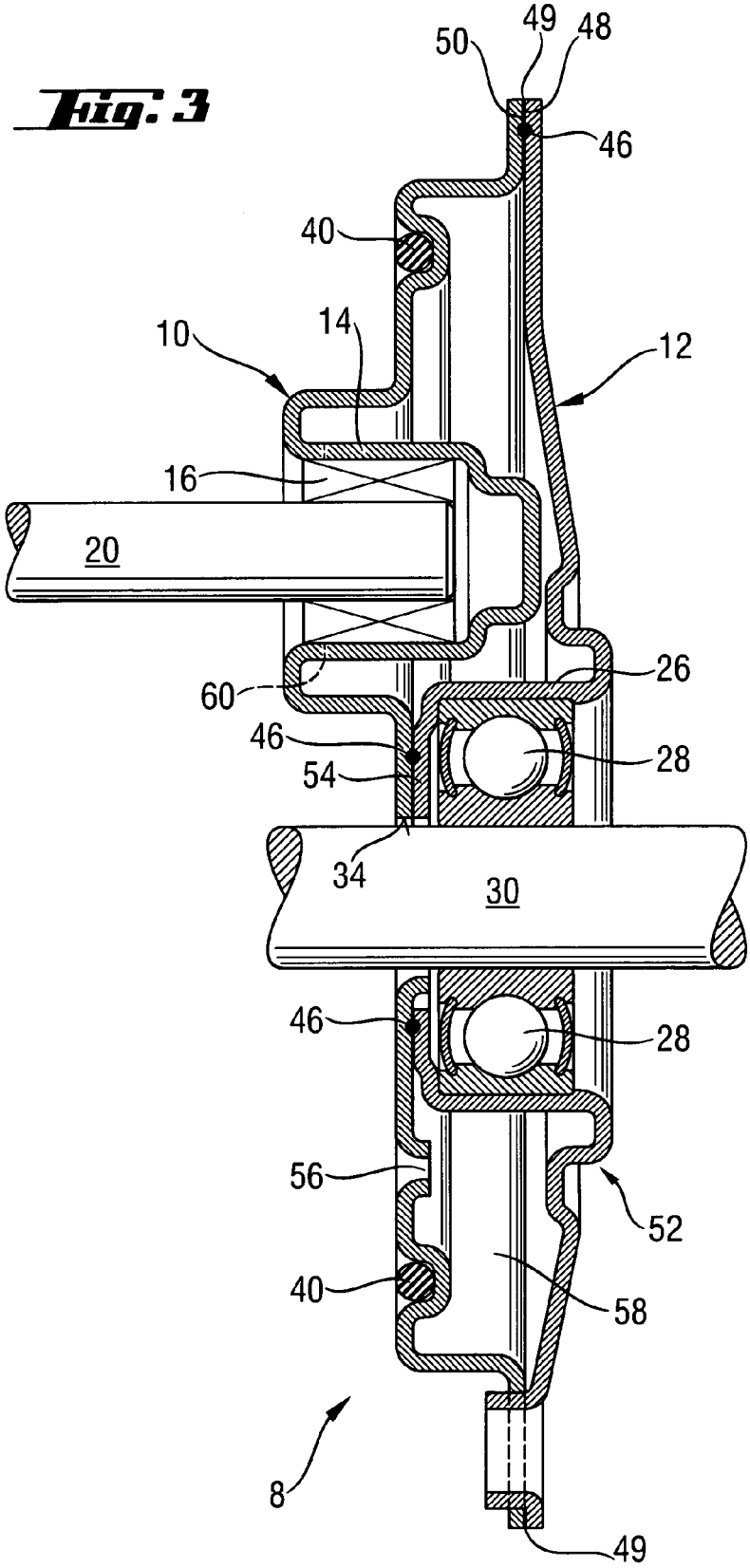
FIG. 3 shows an enlarged longitudinal-section of the mounting bracket.

FIG. 3 shows an enlarged longitudinal-section of the mounting bracket 8 after final assembly, whereby the mounting bracket 10 pointing towards the gearing and the mounting bracket 12 pointing towards the motor show numerous connections 46 in the form of spot-welding. This connection is not the only method of connection: both mounting bracket components (10, 12) can also be attached to each other using other well-known and suitable permanent or non-permanent methods of connection, such as screws.

The mounting bracket components 10, 12 are attached to each other in flat-shaped contact areas, 48, 50 on the spot-welding connection 46. Both contact surfaces feature an adhesive layer 49, which can be thermally activated. The operating temperature of the hand tool is sufficient to activate the adhesive layers 49 and additional rigidity between both mounting bracket components 10, 12 can be attained. The adhesive layer 49 can be created when required such that either non-permanent or permanent adhesion takes place. It is also possible to put an adhesive layer 49 on just one of the mounting bracket components 10, 12.

The shaft collet 26 pointing towards the motor is linked to the rest of the mounting bracket component 12 pointing to the motor via a membranous area 52 with a somewhat s-shaped layer. Vibrations occurring on the motor shaft 30 are cushioned here so that noticeable vibrations to the casing can be avoided in the main.

It is possible to design a bottom 54 in the shaft collet 26 pointing towards the motor in a geometric form of a sling disc or alternatively in the form of a labyrinth disc to protect the ball bearing 28 from losing oil.

The mounting bracket component 10 pointing towards the gearing is also designed with drill holes 56, which connect the interior of the gearing component (4) with an internal space (58) in the mounting bracket (8). A balance in pressure between the dangerous high pressures that can build up in the gearing 4 during operations and the internal space 58 can be avoided, whereby the danger of damage due to high pressure is minimized. Oil coming from the gearing 4 due to drilling can in addition be collected in the internal space 58.

In addition, the shaft collet 14 pointing towards the gearing is, as suggested by the dotted line, linked by a non-permanent alternating connection 60 with the remaining mounting bracket component 10 pointing towards the gearing. The shaft collet 14 pointing towards the gearing is thus presented as a interchangeable bit. The existing shaft collet 14 can be replaced by another shaft collet 14, which is in tune with the new measurements of gearing shaft 20, due to alterations concerning the measurements of the gearing shaft 20, because of, for example, further developments to the electric hand tool 2. The alternating connection 60 can for example be presented in the form of a screw or snapper.

Figure 4:
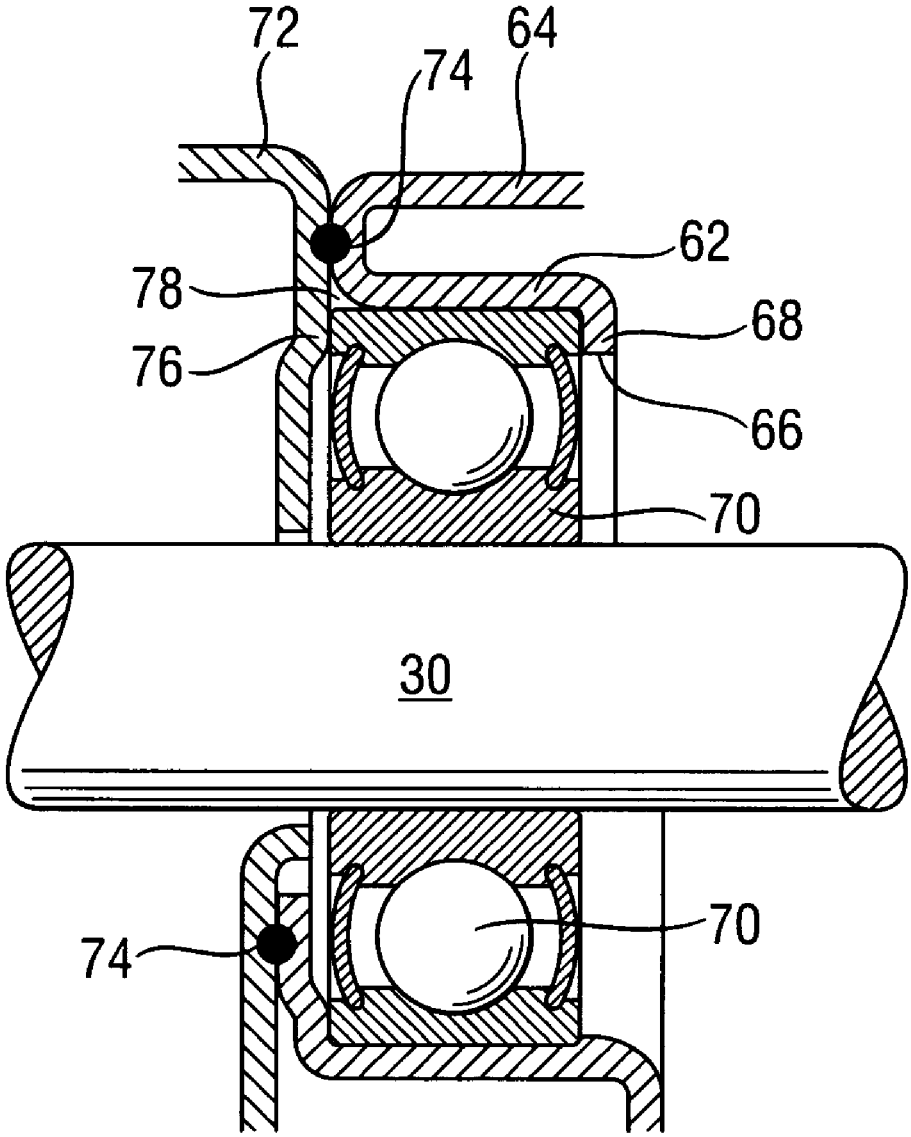
FIG. 4 shows an enlarged detailed cross-section of an alternative shaft collet.

FIG. 4 shows an alternative shaft collect 62 for the first mounting bracket component 64, which is mainly sleeve-shaped. A recess 68 can be found on the first opening 66, to which a bearing 70 is mounted. A second mounting bracket component 72 is linked to the first mounting bracket component 64 by a connection 74. The second mounting bracket component 72 comprises a bund 76, which partially closes the second opening 78, thus fixing the bearing 70 between both mounting bracket components 64, 72. Depending on the connection 74, it is possible that the bearing 70, as illustrated, is screwed in a non-permanent fashion or be welded permanently between both mounting bracket components 64, 72.

The double-side design of mounting bracket 8, as presented in this invention, makes it possible to fix the mounting bracket 10 pointing to the gearing to the gearing component 4 independently of the mounting bracket 12 pointing to the motor, and the mounting bracket 12 pointing to the motor to the gearing component 4 can be fixed to the motor component 6 independently of the mounting bracket 10 pointing to the gearing. Thus, two separate units are created, which can also be checked, tested and further developed separately and independent of each other. Both the gearing component 4 and the motor component 6 can also be mounted prior to the time of final assembly. Both mounting bracket components 10, 12 then only have to be connected to each other during final assembly, which greatly simplifies assembly procedures.

What is claimed is:

1. An electric hand tool with a gearing component (4) and a motor component (6), a mounting bracket (8) is located between the gearing component (4) and the motor component (6) after final assembly, a gear shaft and a motor shaft are suspended on the mounting bracket (8), wherein the mounting bracket (8) features two mounting bracket components (10, 12; 64, 72), the gearing component (4) is allocated to one of the mounting bracket components (10; 72) and the motor component (6) is allocated to the other of the mounting bracket components (12; 64), wherein the two mounting bracket components (10, 12; 64, 72) are linked to each other by a connection (46; 74) and wherein at least one of the mounting bracket components (10, 12; 64, 72) includes interchangeable insert bits.

2. The electric hand tool of claim 1, wherein the mounting bracket components (10, 12; 64, 72) are detachably connected to each other.

3. The electric hand tool of claim 1, wherein the mounting bracket components (10, 12; 64, 72) include a permanent connection (46; 74) after final assembly.

4. The electric hand tool of claim 1, wherein the mounting bracket components (10, 12; 64, 72) include an adhesive layer (49) on mutual contact surfaces (48, 50).

5. The electric hand tool of claim 4, wherein the adhesive layer (49) can be thermally activated.

6. The electric hand tool of claim 1, wherein at least one of the mounting bracket components (10, 12; 64, 72) is a stamping component.

7. The electric hand tool of claim 6, wherein at least one of the mounting bracket components (10, 12; 64, 72) includes a sleeve-like journal bearing (62) showing a block (68) on a first opening (66) and a second opening (78) can at least be partially sealed by the other mounting bracket component (10, 12; 64, 72).

8. The electric hand tool of claim 7, wherein the journal bearing (16; 28, 62) is connected to the remaining mounting bracket component (10, 12; 64, 72) by a membrane sector (52).

9. The electric hand tool of claim 1, wherein at least one of the mounting bracket components (10, 12; 64, 72) includes a mainly bowl-shaped shaft collet (14; 26) to accept a journal bearing (16; 28).

10. The electric hand tool of claim 9, wherein the journal bearing (16; 28) is crimped into the shaft collet (14; 26).

11. The electric hand tool of claim 1, wherein the mounting bracket (8) includes drill holes that connect the interior of the gearing component (4) with an internal space (58) in the mounting bracket (8).

* * * * *